US006547989B1

(12) United States Patent
Ishida

(10) Patent No.: US 6,547,989 B1
(45) **Date of Patent: *Apr. 15, 2003**

(54) INORGANIC-METAL COMPOSITE BODY EXHIBITING RELIABLE PTC BEHAVIOR

(75) Inventor: Yoshihiko Ishida, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 197 days.

This patent is subject to a terminal disclaimer.

(21) Appl. No.: 09/639,240

(22) Filed: Aug. 15, 2000

Related U.S. Application Data

(63) Continuation-in-part of application No. 09/360,465, filed on Jul. 23, 1999, now Pat. No. 6,358,436.

(51) Int. Cl.[7] ..... H01B 1/00

(52) U.S. Cl. ..... 252/500; 252/511; 252/512; 252/518; 361/524; 429/22 R

(58) Field of Search ..... 252/500, 511, 252/512, 518; 361/525; 429/22 R

(56) References Cited

U.S. PATENT DOCUMENTS 6,358,436 B2 * 3/2002 Ishida et al. ..... 252/500

FOREIGN PATENT DOCUMENTS

| | | |
|---|---|---|
| EP | 0 862 191 A1 | 9/1998 |
| JP | 62-214601 | 9/1987 |
| JP | 7-161502 | 6/1995 |
| JP | 9-320811 | 12/1997 |
| WO | 98/11568 | 3/1998 |

OTHER PUBLICATIONS

T. Sawaguchi, et al., "*Effect of Microstructure of Bismuth Metal Particle Filled Ceramic Composite on the PTCR Property,*" Proceedings of the Annual Meeting, 1998, The Ceramic Society of Japan, Mar. 3, 1998, p. 319.

T. Sawaguchi, et al., "*Effect of Resistivity of the Matrix Ceramics in Bismuth Metal Particle Filled Ceramic Composite on the PTCR Property,*" Proceedings of the Fall Meeting, 1997, The Ceramic Society of Japan, Oct. 2, 1997, vol. 10, p. 197.

T. Sawaguchi, et al., "*The PTCR Property of Bismuth Metal Particle Filled Ceramic Composite Sintered by Hot Pressing,*" Proceedings of the Fall Meeting, 1998, The Ceramic Society of Japan, Oct. 1, 1998, vol. 11, p. 106.

* cited by examiner

*Primary Examiner*—Yogendra N. Gupta
*Assistant Examiner*—D G Hamlin
(74) *Attorney, Agent, or Firm*—Burr & Brown

(57) ABSTRACT

An inorganic-metal composite body exhibiting PTC behavior at a trip point temperature ranging from 40° C.–300° C., including an electrically insulating inorganic matrix having a room temperature resistivity of at least $1\times10^6$ Ω·cm, and electrically conductive particles uniformly dispersed in the matrix and forming a three-dimensional conductive network extending from a first surface of said body to an opposed second surface thereof, wherein the composite body has a room temperature resistivity of no more than 10 Ω·cm and a high temperature resistivity of at least 100 Ω·cm. Preferably, the electrically conductive particles are made of a Bi-based alloy containing at least 50 wt % Bi, and have an average diameter, $\phi_{ave}$, of 5–50 μm and a 3σ particle size distribution of 0.5 $\phi_{ave}$–2.0 $\phi_{ave}$. Also disclosed is an inorganic PTC device including an intermediate electrode layer to insure adhesion of outer termination electrodes to the PTC composite body, and a method of forming the composite body, which method effectively deals with the volatility of the electrically conductive particles.

11 Claims, 7 Drawing Sheets

INORGANIC-METAL COMPOSITE BODY EXHIBITING RELIABLE PTC BEHAVIOR

CROSS REFERENCE TO RELATED APPLICATION

This is a continuation-in-part application of U.S. Ser. No. 09/360,465, filed Jul. 23, 1999, the entirety of which is incorporated herein by reference U.S. Pat. No. 6,358,436.

FIELD OF THE INVENTION

The present invention relates to resettable PTC devices made of inorganic-metal composite materials, and more particularly to a body of such composite material having a room temperature resistivity of less than 10 Ω·cm and a high temperature resistivity of at least 100 Ω·cm.

BACKGROUND OF THE INVENTION

Positive Temperature Coefficient (PTC) materials exhibit a sharp increase in resistivity over a particular temperature range. As such, these materials have been used widely as resettable fuses for protecting circuits against overcurrent conditions.

Two types of PTC materials have been proposed in the past: ceramic-based PTCs and polymer-based PTCs. Ceramic PTCs made of, for example, barium titanate, have been used in heaters and in some circuit protection applications. Ceramic PTCs have not been widely adopted for circuit protection devices, however, since the room temperature resistivity of those materials is too high for use in circuits of consumer electronic products, for example.

In view of the problems associated with ceramic PTC materials, the industry has adopted polymer-based materials. Such polymer-based PTC materials include a matrix of polymer material in which conductive particles, such as carbon black, are uniformly dispersed to form a conductive network through the material. The resistivity of the polymer PTC is controlled by varying the content of conductive particles. The range of conductive particle content within which the polymer composite material exhibits PTC behavior is known as the percolation threshold range.

FIG. 1 is an operating curve for a typical polymeric PTC device. The PTC device will generate heat as current passes therethrough. The device will operate in region 1 as long as the amount of heat generated in the device can be dissipated to the ambient environment. In an overcurrent condition, the heat generated by the device exceeds the ability of the ambient environment to absorb that heat, and, consequently, the temperature of the device increases. When the temperature of the device reaches the melting point temperature of the polymer matrix, the polymer melts, expands and disrupts the conductive network of carbon black particles formed therein. Once the conductive network is disrupted, the resistivity of the polymeric material increases sharply as shown in FIG. 1, to thus allow only a very small amount of current to pass therethrough. Region 3 shown in FIG. 1 basically represents the resistivity of the polymeric composite material in the melted state. Once the overcurrent condition is terminated (e.g., by switching off the electronic device), the polymer recrystallizes and effectively reconstructs the conductive network of carbon black particles. The device then operates in region 1 of FIG. 1 until a subsequent overcurrent condition occurs.

While polymeric PTC devices have been widely adopted in industry, there are several problems associated with these devices.

First, while the magnitude of resistivity in region 1 of a polymeric PTC device can be adjusted by changing the amount of conductive particles added to the polymer matrix, the trip point temperature ($T_{TP}$) is dependent solely upon the melting point of the polymer. Polyethylene is the material of choice in polymeric PTC devices, and melts at about 150° C. Accordingly, all polymeric PTC devices employing polyethylene as the matrix material will trip when the device temperature reaches 150° C.

Second, the breakdown voltage of polymeric PTC devices is relatively low (e.g., less than 100 V/mm), primarily due to the relatively low breakdown voltage of polymer materials such as polyethylene.

Third, there is a time lag between the occurrence of an overcurrent condition and the tripping of the polymeric PTC device. Specifically, the "trip time" of a polymeric PTC device is on the order of 100 milliseconds. Consequently, some or all of the overcurrent could be transmitted to downstream electronic components within this time lag.

Fourth, polymeric PTC devices do not return to their initial resistivity value after tripping. Specifically, the first time a polymeric PTC device trips, and the polymer matrix melts as explained above, the initial conductive network of carbon black particles is disrupted. The carbon black particles do not assume the same network when the polymeric matrix cools to region 1 of FIG. 1 since the structure of the polymer matrix changes slightly. Consequently, the magnitude of resistivity in region 1 essentially doubles after the polymeric PTC device is tripped for the first time. Such an increase in region 1 resistivity is unacceptable, especially in devices where the initial resistivity of the polymeric PTC device plays an important role in the design of the electronic circuit.

Fifth, polymeric PTC devices require several hours, if not several days, to reset. Specifically, once the polymeric matrix melts as a result of an overcurrent condition, it could take several hours or days for the polymeric matrix to recrystallize and again become conductive (by restoration of the conductive network of carbon particles). This is unacceptable since an electronic device in which the polymeric PTC device is disposed cannot operate until the PTC device resets.

Sixth, the heat resistance of polymeric PTC devices is unacceptably low (i.e., less than 200° C.). As explained above, the polymeric matrix, if formed of polyethylene, will melt at about 150° C. to disrupt the conductive network of carbon black particles in the device. However, in certain severe overcurrent conditions, the PTC device itself can be heated above the melting point of the polymer and perhaps even above the decomposition temperature of the polymer itself. That is, a severe overcurrent condition can cause decomposition of the polymer matrix if the current flowing through the device generates excessive Joule heating. Decomposition of a polymeric material essentially forms carbon (which is electrically conductive) and essentially renders the device permanently inoperative. Accordingly, the PTC device is no longer resettable.

Finally, certain overcurrent conditions can cause shorting around the ends of the polymeric material (known as "tracking") and even through certain local regions of the polymeric material. These short circuit conditions create local areas of decomposition in the polymeric material, which in turn result in permanent conductive paths of carbon in the device. Such conductive paths are, of course, unacceptable, as the device will no longer exhibit a sharp increase in resistivity at the trip point temperature.

It would be desirable to develop a PTC material that does not suffer from the excessive resistivity problems of traditional ceramic PTC materials and also does not suffer from the numerous drawbacks associated with polymeric PTC materials.

While extensive research has been conducted in the area of polymeric PTC devices in an attempt to overcome some of the above problems, the industry, until recently, had not been able to provide a PTC material that overcomes all of the problems discussed above with respect to both traditional ceramic and polymeric PTC materials. There has been recent disclosure, however, of a PTC thermistor material including a ceramic matrix and conductive particles dispersed therein. Specifically, WO 98/11568 (EP0862191) discloses such a composite material device that purports to exhibit reliable PTC behavior. However, the device must make use of a semi-insulating matrix material in order to attain acceptably low room temperature resistivity. While insulating ceramic matrix materials (e.g., $Al_2O_3$) are disclosed, the room temperature resistivity of the devices employing these materials is unacceptably high (~1000 Ω·cm). Moreover, the use of semi-insulating matrix materials often results in unacceptably low high temperature resistivities (above the trip point temperature of the device), and the cost of such semi-insulating materials tends to be prohibitive. Accordingly, WO '568 does not disclose a device that simultaneously can achieve low (e.g. <10 Ω·cm) room temperature resistivity and acceptable high temperature resistivity, while being made of a relatively inexpensive matrix material.

SUMMARY OF THE INVENTION

It is an object of the present invention to provide a PTC material that overcomes all of the above-discussed drawbacks associated with conventional ceramic and polymeric PTC materials.

Specifically, it is an object of the present invention to provide an inorganic-metal composite body that exhibits reliable PTC behavior over a broad range of selectable trip point temperatures. The composite body of the present invention can be made from relatively inexpensive inorganic materials, such as insulating ceramic materials, while still exhibiting relatively low room temperature resistivity (≦10 Ω·cm) and a resistivity ratio (high temperature resistivity/room temperature resistivity) of at least 10.

In accordance with one object of the present invention, an inorganic-metal composite body is provided that exhibits PTC behavior at a trip point temperature ranging from 40° C.–300° C., and comprises an electrically insulating inorganic matrix having a room temperature resistivity of at least $1\times10^6$ Ω·cm, and electrically conductive particles uniformly dispersed in the matrix to form a three-dimensional conductive network extending from a first surface of said body to an opposed second surface thereof. The composite body has a room temperature resistivity of no more than 10 Ω·cm and a high temperature resistivity, above the trip point temperature, of at least 100 Ω·cm, preferably at least 1000 Ω·cm, and more preferably at least 10,000 Ω·cm.

The force that drives the PTC behavior in the composite body of the present invention lies in the ability of the electrically conductive particles to shrink at least 0.5% by volume at or above the melting point thereof. When excessive current passes through the body, the heat generated in the body causes the conductive particles to melt, shrink, and thus disrupt the conductive network passing through the body. This is the same basic manner in which the materials of WO '568 purport to function as PTC devices.

During the course of the inventor's research, it was discovered that the inherent defects of the materials disclosed in WO '568 could be overcome by focusing on the specific composition of the electrically conductive particles. Accordingly, another object of the present invention is to provide the above-described inorganic-metal composite body, wherein the electrically conductive particles consists essentially of Bi in an amount of at least 50 wt %, and at least one additional metal element selected from the group consisting of Sn, Pb, Cd, Sb and Ga. If the amount of Bi is less than 50 wt %, then the electrically conductive particles do not shrink to a sufficient extent so as to allow reliable PTC behavior in the composite body. Binary alloys made up of Bi and one of these other metals can be used, as can ternary alloys such as Bi—Sn—Ga, Bi—Sn—Pb and Bi—Sn—Cd.

During the course of the inventor's research, it was also discovered that the inherent defects of the materials disclosed in WO '568 could be overcome by focusing on the particle sizes and particle size distributions used in formulating the electrically insulating inorganic matrix and electrically conductive particles. That is, the inventor discovered that a specific relationship should exist between the size of the inorganic particles used to make the matrix and the size of the electrically conductive particles in order to provide sufficient and uniform spacing between the electrically conductive particles in the final sintered body. Complete disclosure of this discovery is outlined in applicant's copending U.S. application Ser. No. 09/324,263, filed Jun. 2, 1999, the entirety of which is incorporated herein by reference.

The inventor also discovered that the particle size distribution of the electrically conductive particles is important in providing the composite body with acceptably low room temperature resistivity (i.e., less than 10 Ω·cm) within the percolation range of the material. Accordingly, it is another object of the present invention to provide the above-described composite body with electrically conductive particles having an average particle size ($\phi_{ave}$) ranging from 5 microns to 50 microns and a 3σ particle size distribution ranging from 0.5 $\phi_{ave}$ to 2.0 $\phi_{ave}$. It is also preferred that no more than 5 vol % of the electrically conductive particles in the composite body be smaller than 5 microns.

While researching the composite body of the present invention, the inventor also discovered that traditional electrode termination techniques could not be used. Specifically, it was discovered that the bond between conventional (e.g., Ni, Ag, Cu) electrodes formed on the outer surface of the composite body and the constituents of the composite body would deteriorate each time the conductive particles in the composite body melted. In addition, the alloy particles in the composite body would migrate toward the conventional electrode materials and form an alloy, thus leaving a depleted area within the composite body that increased the resistivity of the overall device.

Accordingly, another object of the present invention is to provide an inorganic-metal composite body that exhibits reliable PTC behavior, while enabling the use of conventional electrode termination materials, such as Ni, Ag and Cu. In accordance with this object of the invention, an inorganic-metal composite body is provided that preferably includes the composite body described above, an intermediate layer and an outer electrode layer. The intermediate layer includes inorganic particles, preferably the same as the composite body, and an electrically conductive network formed therethrough. The electrically conductive network is defined by a metal or alloy that (i) has a higher melting point temperature than that of the conductive particles in the composite body, and (ii) will not form a eutectic alloy with the conductive particles in the composite body either during manufacture or use of the device. Use of such an intermediate layer enables the use of conventional electrodes to terminate the opposite ends of the composite body according to the present invention.

In addition to the above, the inventor discovered that use of electrically conductive particles having relatively low melting point temperatures presents difficulty when attempting to manufacture the composite body of the present invention using traditional ceramic processing techniques. Specifically, electrically insulating materials such as alumina, mullite, and the like, are typically fired at 1200–1500° C. However, the vaporization temperature of most bismuth-based alloys is but a fraction of that sintering temperature. Accordingly, traditional firing techniques must be modified to prevent vaporization of the electrically conductive particles during formation of the fired inorganic-metal composite body.

Accordingly, it is yet another object of the present invention to provide a method of making the above-described composite body, wherein an additive is added to the batch material that includes the electrically insulating inorganic material and the electrically conductive particles, to act as a vaporization suppressing aid during sintering of the composite body. The vaporization suppressing aid is preferably a glass-based sintering aid having a glass transition temperature that is lower than the vaporization temperature of the electrically conductive particles included in the batch material. The additive melts during the sintering operation at a temperature below the vaporization temperature of the electrically conductive particles, and forms an envelope around the electrically conductive particles that effectively prevents the vaporized material from escaping the composite body. Use of such a vaporization suppressing aid preserves the amount of electrically conductive material in the final sintered composite body.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
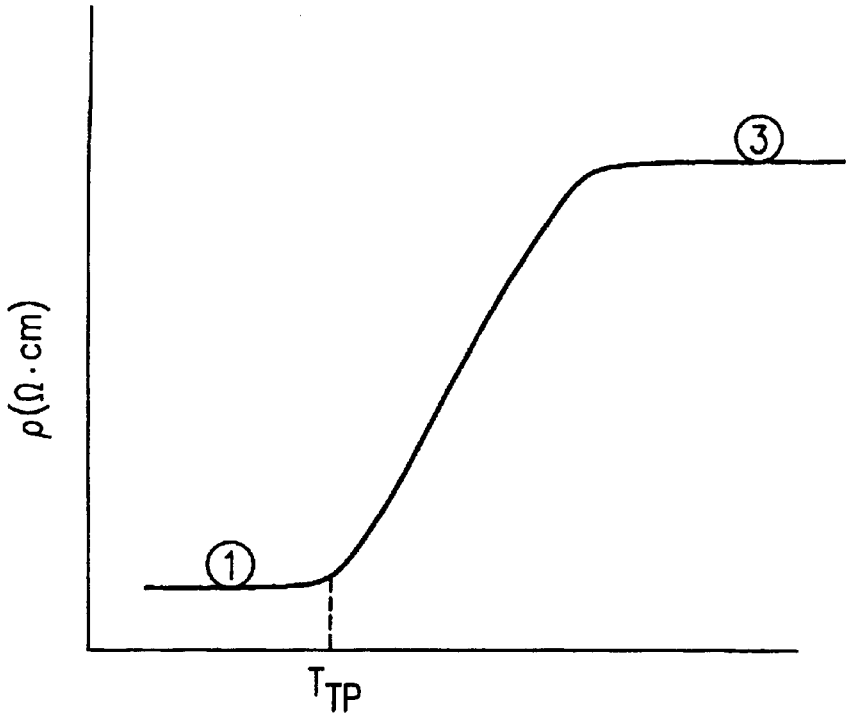
FIG. 1 is a graph showing the resistivity vs. temperature characteristics of a traditional polymer PTC device.

The composite body of the present invention includes a matrix of electrically insulating material and electrically conductive particles dispersed uniformly therein. The conductive particles form a three-dimensional conductive network throughout the composite body. When the composite body is heated to the melting point temperature of the conductive particles, the particles undergo a slight volumetric reduction (e.g., >0.5 vol %) to disrupt the conductive path through the composite body. As a result, the composite body exhibits a sharp increase in resistivity (i.e., PTC behavior) at the melting point of the conductive particles. The melting point temperature of the electrically conductive particles thus defines the trip point temperature of the composite body when used as a PTC device.

The matrix can be made of any electrically insulating material that will maintain its shape throughout the potential operating temperature of the PTC device. The matrix preferably is made of inorganic electrically insulating materials, with ceramic materials being most preferred. Examples of suitable ceramic materials include alumina, silica, zirconia, magnesia, mullite, cordierite, aluminum silicate, forsterite, petalite, eucryptite and quartz glass. The matrix material should have a low thermal expansion coefficient to avoid thermal shock failure when the device heats and cools during trip cycles. In this regard, mullite, cordierite, petalite, eucryptite and quartz glass are preferred from the above list.

The electrically conductive particles are selected from Bi-based alloys (binary and/or ternary), preferably eutectic Bi-based alloys. It is also important that the metals used to form eutectic alloys with Bi not form intermetallic compounds with Bi, as such compounds form a dense crystal structure unlike the original less dense crystal structure of the Bi alloy. Such a dense crystal structure would upset the melt shrinkage properties of the composite body. The alloys must have melting point temperatures within the potential operating temperature of the PTC device and exhibit volumetric shrinkage at their respective melting points. Metals that fulfill these criteria when alloyed with Bi include Sn, Pb, Cd, Sb and Ga. Preferred binary eutectic alloys include Bi—Sn, Bi—Pb, Bi—Cd, and Bi—Sb, while preferred ternary alloys include Bi—Sn—Ga, Bi—Sn—Cd and Bi—Sn—Pb. The melting point temperature of each of these eutectic alloys is less than 300° C.

It is important for the alloys to have a eutectic point composition in the binary or ternary alloy system to lower the trip point temperature to 200° C. or less. PTCR devices mounted on an electrical circuit board should have a trip point temperature on this level to insure safety.

The amount of Bi in the alloy should be sufficient to insure at least 0.5% volume reduction (preferably at least 1.0 vol %) in the alloy particles when melted. Generally speaking, the alloy should include at least 50 wt % Bi to achieve at least 0.5 vol % shrinkage upon melting. Bi should be present in an amount of at least 60 wt % in Bi—Sn alloy, at least 55 wt % in Bi—Pb alloy and at least 67 wt % in Bi—Cd alloy. All ranges of Bi will provide adequate volume reduction in the Bi—Sb system.

The amount of Bi (in weight %) necessary to achieve at least 0.5% melt shrinkage can be calculated using the following formula:

$$1-\{(W_{Bi}/\rho_{Q(Bi)}+W_{metal}/\rho_{Q(metal)})/(W_{Bi}/\rho_{S(Bi)}+W_{metal}/\rho_{S(metal)})\}$$

wherein $W_{Bi}$ is the amount (in weight %) of Bi in the alloy, $W_{metal}$ is the amount (in weight %) of the other metal (e.g., Sn) in the alloy, $\rho_{Q(Bi)}$ is the density of Bi in a liquid state, $\rho_{Q(metal)}$ is the density of the other metal in a liquid state, $\rho_{S(Bi)}$ is the density of Bi in a solid state, and $\rho_{S(metal)}$ is the density of the other metal in a solid state. Knowing that Bi shrinks 3.3 vol % when melted and Sn shrinks −2.8 vol % (i.e., expands) upon melting, $\rho_{Q(Bi)}$ and $\rho_{Q(Sn)}$ can be determined using $\rho_{S(Bi)}$ and $\rho_{S(sn)}$ values of 9.803 g/cm$^3$ and 7.30 g/cm$^3$. Thereafter, using the above formula in a trial and error calculation method, it can be determined that, in the BiSn alloy system, for example, at least 60 wt % Bi is necessary to achieve a melt shrinkage of at least 0.5%. With respect to Sb, Pb and Cd, each of those metals exhibits melt shrinkage of 0.95%, −3.5% and −4.7%, respectively (i.e., Pb and Cd expand upon melting). The fact that Sb alone shrinks upon melting explains why all ranges of Bi will provide adequate volume reduction in the Bi—Sb system.

Figure 2:
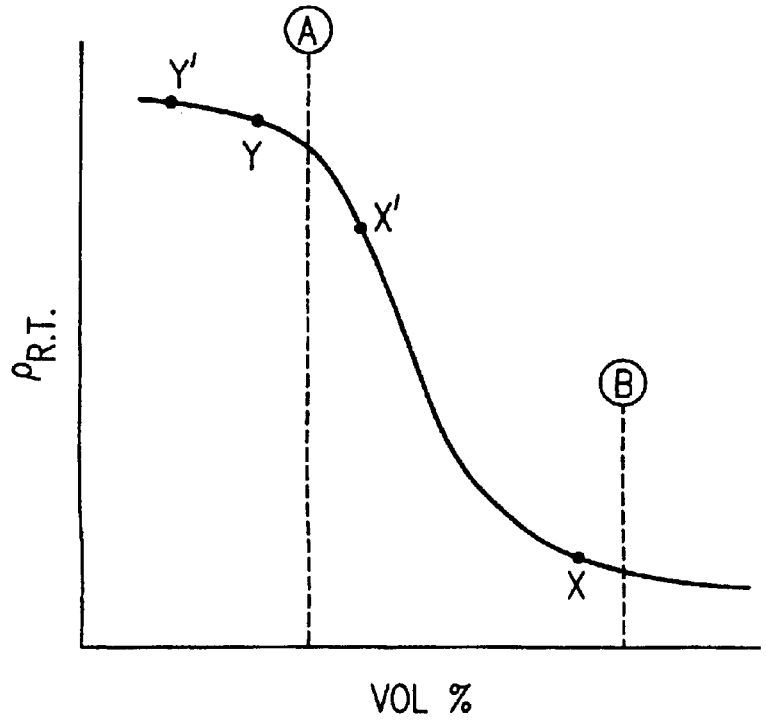
FIG. 2 is a graph of room temperature (i.e., 30° C.) resistivity vs. volume percent of conductive particles for various inorganic-metal composite PTC devices according to the present invention.

FIG. 2 is a graph showing the relationship between the resistivity of the composite material and the content of alloy particles in the composite. The percolation threshold range for the composite material extends from point A to point B. The volume percent of alloy particles in the composite is selected within this range in order to establish PTC behavior in the resultant composite body. The initial resistivity of the composite can be adjusted by varying the amount of alloy particles within this range.

When an overcurrent condition occurs in the PTC device, the volume of each alloy particle will decrease about 3 volume percent (most preferably), the electrical conduction through the composite material will be disrupted, and the resistivity thereof will increase from point X to point Y in FIG. 2. Similarly, if the volume percent of alloy particles is near the lower end of the percolation threshold range, the resistivity of the composite material will increase from X' to Y' at the melting point temperature of the alloy particles. Accordingly, it can be appreciated from FIG. 2 that any volume percent value within the percolation threshold range will result in substantially increased resistivity at the melting point temperature of the alloy particle. It can also be appreciated from FIG. 2 that the resistivity ratio (i.e., room temperature resistivity/high temperature resistivity) of the PTC device increases as the volume percentage of alloy particles approaches the upper end "B" of the percolation threshold range.

Generally speaking, the composite material should include 20–40 volume percent alloy particles, more preferably 25–35 volume percent. Again, the room temperature resistivity and resistivity ratio of the composite material can be adjusted by varying the amount of alloy particles within this range.

The percolation threshold range and the room temperature resistivity of the device are also dependent upon the particle size distribution of electrically conductive particles in the composite body. The average particle size ($\phi_{ave}$) of conductive particles should range from 5 $\mu$m to 50 $\mu$m, preferably 15 $\mu$m to 25 $\mu$m, and the 3$\sigma$ particle size distribution should range from 0.5 $\phi_{ave}$ to 2.0 $\phi_{ave}$. It is also preferred that no more than 5 volume % of the conductive particles in the composite body be smaller than 5 $\mu$m.

The trip point temperature ($T_{TP}$) of the composite material can be adjusted over a relatively wide range by changing the composition of the alloy particles. Specifically, the melting point temperature of the alloy particles will change as the composition of those particles changes. Accordingly, a PTC device having a specific trip point temperature can be designed easily by using a conductive particle made of a specific alloy having a liquidus point temperature where the melt shrinkage is at least 0.5 vol %, which temperature substantially equals the trip point temperature of the intended PTC device.

It is preferred that the porosity of the composite body be kept as low as possible (e.g., no more than 5 volume percent). This will assist in the maintenance of a substantially constant room temperature resistivity in the composite body even after several trip cycles. Specifically, the composite body of the present invention has a microstructure wherein the matrix of electrically insulating material defines the position of each alloy particle. When the device is subjected to an overcurrent condition, each of the alloy particles melts and shrinks. The molten particles do not move to any substantial extent throughout the microstructure of the matrix due to the low porosity in the matrix (i.e., there are no vacant pores into which the molten particles could flow). Accordingly, when the device cools and the alloy particles resolidify, they will occupy substantially the same position within the matrix as before the overcurrent condition. Accordingly, there will be no substantial change in initial resistivity of the composite material before and after the trip cycle due to repositioning of the alloy particles (i.e., the conductive network is maintained from one trip cycle to the next).

Figure 3:
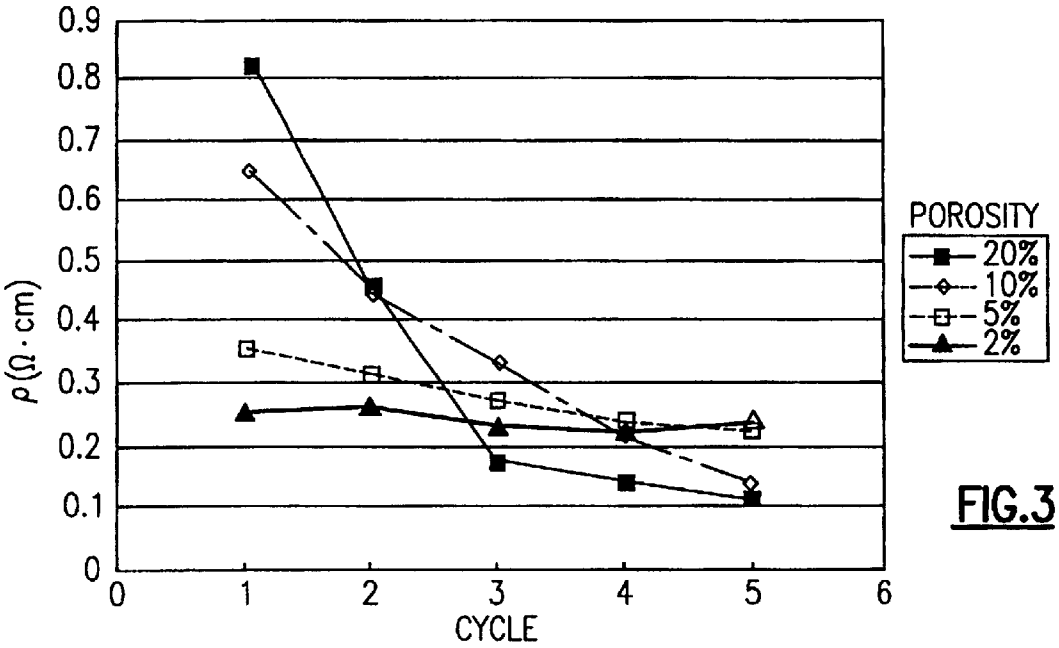
FIG. 3 is a graph showing the effect of porosity on room temperature resistivity of the composite body after several trip cycles.

FIG. 3 graphically demonstrates the effect of porosity on room temperature resistivity of the composite body after several trip cycles. As the porosity in the fired composite body is reduced to 5 vol % or less, preferably 2 vol % or less, the room temperature resistivity of the body returns to its original value after each trip cycle.

The use of alloy particles having eutectic point compositions also ensures that the microstructure of the individual alloy particles does not change substantially after the trip cycle. That is, by using substantially eutectic compositions, the microstructure of the alloy particles before the overcurrent condition will be reestablished in the cooled device after the trip cycle. Accordingly, there also will be no substantial change in initial resistivity after the trip cycle due to a change in microstructure of the individual alloy particles.

A method of forming the composite body of the present invention and a PTC device incorporating that body will now be described.

A batch material for extrusion is prepared by mixing predetermined amounts of electrically insulating material, electrically conductive particles, a sintering aid, a plasticizer (as needed), an organic binder (as needed) and water. The resultant batch mixture is extruded to form a composite PTC body, which is then fired to integrate the electrically insulating material into a matrix in which the electrically conductive particles are fixed. The presence of low melting point electrically conductive particles presents a problem during the sintering operation, since those particles begin to vaporize at temperatures well below the temperature required to sinter the electrically insulating matrix material. Accordingly, it is necessary to select a sintering aid that impedes vaporization of the electrically conductive particles during the sintering operation. This aspect of the invention, each of the ingredients used to prepare the batch material, and other details of the method used to form the composite body, will be discussed below.

Electrically Conductive Particles

Any of the Bi-based alloys described hereinabove can be used for the electrically conductive particles. The amount of electrically conductive particles can range from 20–40 volume percent, more preferably 25–35 volume percent, most preferably around 30 volume percent. It is also preferred that the average particle size ($\phi_{ave}$) of the electrically conductive particles range from 5–50 μm (preferably 15–25 μm), with the maximum particle size being no more than 50 μm (preferably ≦25 μm) and the minimum particle size being at least 0.5 μm (preferably ≧15 μm). The average particle size of the electrically conductive particles should exceed the average particle size of the electrically insulating particles in order to provide a uniform conductive network through the composite body.

It is also preferred that the electrically conductive particles have a 3σ particle size distribution ranging from 0.5 $\phi_{ave}$ to 2.0 $\phi_{ave}$. It is also preferred that no more than 5 volume % of the conductive particles in the composite body be smaller than 5 μm.

Electrically Insulating Material

Any of the materials described hereinabove can be used for the electrically insulating material. The amount of insulating material should equal 100 vol % minus the amount of electrically conductive material and other additives.

Preferably the average particle size of the primary particles of electrically insulating material ranges from 1 to 3 μm, with a maximum particle size being less than 20 μm, preferably less than 10 μm. A particle size and distribution of this type assist in maintaining a relatively low porosity (i.e., no more than 5%) in the final, sintered composite body. If the maximum particle size exceeds 20 μm, then it becomes difficult to form a uniform network of conductive particles through the composite body, with the result being that the room temperature resistivity of the composite body tends to be unacceptably high (e.g., above 10 Ω·cm).

Sintering Aid

Figure 4:
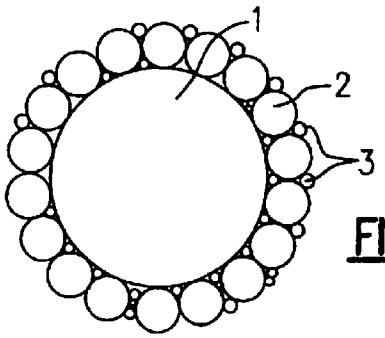
FIG. 4 shows the positional interrelationship of the electrically conductive particles, electrically insulating particles and sintering aid particles in the composite body before firing.

The sintering aid must be a material that can encapsulate the electrically conductive particles during the sintering operation in order to suppress vaporization of those particles during sintering. Preferably, the sintering aid should form a glassy phase during sintering at or below the vaporization temperature of the electrically conductive particles in order to encase those particles and prevent their vaporization. Examples of such sintering aids include silicate glass, alumino-silicate glass, boro-silicate glass, phosphate glass and alumino-boro-silicate glass, each having an average particle size of less than 1.0 μm, preferably less than 0.1 μm, and more preferably less than 0.01 μm. Colloidal forms of these glasses are also suitable. Selection of a sintering aid with these particle size ranges in mind assures that the electrically conductive particles 1 are physically encased within the electrically insulating particles 2 and the smaller sintering aid particles 3, as shown in FIG. 4. The amount of sintering aid preferably ranges from 3–10 volume percent, more preferably about 5 volume percent.

Plasticizer

The amount of plasticizer, when used, varies depending upon the formability of the other components discussed above. Typically, the plasticizer will be added in an amount of 10–20 volume percent, more preferably about 15 volume percent, and the average particle diameter of the plasticizer will range from 2 to 3 μm. One example of a suitable plasticizer is inorganic clay.

Organic Binder

The amount of organic binder should be kept as low as possible in order to prevent the formation of pores upon burnout of the binder. Preferably no organic binder is used, but in those cases where it is necessary to provide sufficient green strength for the extruded body, the organic binder can be added in an amount of about 2 weight percent.

By minimizing the amount of organic binder in the green extruded body, it is possible to eliminate a binder burnout step prior to sintering. Omission of this step is important in that it provides less opportunity for vaporization of the electrically conductive particles in the extruded body.

Firing Cycle

After the extruded body is dried, it is placed in a furnace for firing. A typical firing profile includes heating the body up to 900° C. at a relatively fast firing rate (greater than 100° C./hr.). This portion of the firing step typically takes less than 20 minutes. It is at this temperature that the electrically conductive particles have a tendency to vaporize. Accordingly, the glass transition temperature of the sintering aid should be selected to substantially match (or, more preferably, be less than) the vaporization temperature of the electrically conductive particles. In this way, the sintering aid will form a glassy shell around the particles that is essentially gas tight to inhibit vaporization of the electrically conductive particles.

The heating rate above the glass transition temperature of the sintering aid is reduced to less than 100° C./hr., preferably about 50° C./hr., until a sufficiently high temperature is reached to allow sintering of the electrically insulating material. For materials like alumina, for example, the sintering temperature could range from 1250° C. to 1400° C. The sintering temperature is maintained until sintering is complete (i.e., until the porosity of the composite body is reduced to no more than 5 vol %), which typically takes 1 to 3 hours.

Device Fabrication

The composite body formed above can be used as a PTC composite device by forming metallization electrodes on opposed surfaces of the body. Use of relatively low melting point electrically conductive particles in the composite body, however, presents problems that prevent direct use of conventional metallization electrodes. Typically, electronic ceramic bodies are terminated electrically by applying metal, such as nickel, silver, or copper directly on the surfaces of the electronic ceramic. In the composite body of the present invention, such electrodes would adhere directly to the electrically conductive particles exposed on the surface of the composite body. When those particles melt during a trip cycle, however, the bond between the electrode and the composite body would be deteriorated.

In order to solve this problem, an intermediate electrode layer is formed on the upper surface of the composite body before application of the conventional metallization electrode material. Specifically, after the green/unsintered composite body is formed through extrusion, a green/unsintered layer of composite material is laminated (or a slurry of the composite material is deposited) on the surface of the green-unsintered composite body, and then co-sintered therewith to form an intermediate electrode layer. The intermediate electrode layer includes an electrically insulating material component, which is preferably the same material as that of the composite body, and an electrically conductive component that has a melting point higher than the melting point of the electrically conductive particles in the composite body. Conventional metallization layers are then formed on the sintered intermediate electrode layer. The bonding interface between the outer electrode and the composite body is preserved since the electrically conductive component of the intermediate electrode layer does not melt when the lower melting point electrically conductive material in the composite body melts when the PTC device is tripped.

While the electrically conductive material of the intermediate electrode layer is not particularly limited, it must not form a eutectic alloy or intermetallic compound with the electrically conductive particles of the composite body. That is, it must be a metal that will not form a eutectic alloy or intermetallic compound with the metal elements of the electrically conductive particles in the composite body at or below the sintering temperature of the electrically insulating material in the composite body. It is acceptable if the metal of the intermediate electrode layer is capable of forming a eutectic alloy with the metal elements of the composite body above the sintering temperature of the electrically insulating material, since the final PTC device will never be exposed to such high temperatures during use.

It is also acceptable if the metal is capable of forming a non-eutectic alloy with the metals in the composite body, since only eutectic alloys have lower melting temperatures than the alloy in the composite body, and thus are damaging to the resistivity of the PTC device. That is, formation of a eutectic alloy in the intermediate electrode layer causes migration of the metal elements from the upper surface of the composite body. This in turn causes a depleted zone at the interface between the composite body and the intermediate electrode layer. The depleted zone is highly electrically insulating, since the metal elements from that zone have migrated into the intermediate electrode layer. Such a highly electrically insulating layer would cause an undesirable increase in the room temperature resistivity of the PTC device.

Examples of metals that can be used in the intermediate electrode layer include Cr, Zr, W and Mo, as well as metal silicides, such as $TiSi_2$, $ZrSi_2$, $VSi_2$, $NbSi_2$, $TaSi_2$, $CrSi_2$, $MoSi_2$, $WSi_2$, borides such as $TiB_2$, $ZrB_2$, $HfB_2$, $VB_2$, $NbB_2$, $TaB_2$, $CrB_2$, $MoB_2$, $W_2B_5$, nitrides such as TiN, ZrN, HfN, VN, NbN, TaN, $Cr_2N$, $Mo_2N$, $W_2N$, and carbides such as TiC, ZrC, HfC, $V_4C_3$, NbC, TaC, $Cr_3C_2$, $Mo_2C$, and WC.

It was also discovered that use of the intermediate electrode layer as described above helps to maintain the initial resistance of the PTC device even if the materials of the electrically conductive particles in the composite body happen to vaporize during manufacture or use. Specifically, since the first electrically conductive particles in the composite body tend to vaporize at the outer surface thereof, the use of the intermediate electrode layer as described above in effect provides a protective coating to prevent vaporization of the first electrically conductive particles in the composite body. In a preferred embodiment, the electrically conductive component of the intermediate electrode layer (i.e., second electrically conductive particles) is dispersed uniformly throughout the composite body, in an amount less than 50 vol % with respect to the total amount of electrically conductive component in the PTC sintered body. The second electrically conductive particles ensure that a conductive network exists throughout the body even if some of the first electrically conductive particles in the composite body vaporize during manufacture or use. The amount of second electrically conductive particles is limited to less than 50% to ensure that the overall PTC effect in the composite body is not adversely affected.

The second electrically conductive particles can be uniformly dispersed throughout the composite body, in an amount less than 50 vol % with respect to the total amount of electrically conductive component in the PTC sintered body, regardless of whether the intermediate electrode is used. The second electrically conductive particles uniformly dispersed throughout the composite body help to maintain the conductive network throughout the body in the event some of the first electrically conductive particles vaporize.

If the second electrically conductive particles are dispersed uniformly throughout the PTC composite body, then it is sufficient that the intermediate electrode layer consists only of the insulating matrix and second electrically conductive particles. If, on the other hand, the PTC body contains the first electrically conductive particles only, it is preferred to use a PTC intermediate layer between the PTC body and the above-described intermediate electrode layer. The PTC intermediate layer preferably includes a mixture of the insulating matrix, the first electrically conductive particles and the second electrically conductive particles. Again, the second electrically conductive particles should be present in an amount less than 50 vol % with respect to the total amount of electrically conductive particles present in any given layer of the overall PTC device.

EXAMPLES

The following examples demonstrate the effectiveness of certain aspects of the present invention. The Examples are exemplary only, and thus should not be interpreted to limit the present invention.

Example I

Example I demonstrates the importance of maintaining 20 to 40 vol % electrically conductive particles in the sintered composite body.

Mullite powder (average primary particle diameter=1.5 $\mu$m; average secondary particle diameter=3 $\mu$m) was used as the high electrical resistance material and bismuth metal (average primary particle diameter=20 $\mu$m) was used as the electrically conductive material in mixing proportions shown in Table 1. A sintering aid of $ZnO—B_2O_3—SiO_2$ was added in an amount of 3.0% by volume. The mixture of these materials was kneaded with a vacuum kneader and, after kneading, extruded using a vacuum extrusion formation device. The extruded bodies were dried at 100° C. and then preliminarily sintered at 700° C. for 3 hours in a nitrogen gas flow of 5 l/minute. Thereafter, the bodies were primarily sintered at 1250° C. for 3 hours in the same atmosphere to form composite sintered bodies.

The volume ratio of the electrically insulating matrix and the conductive material in each of the sintered bodies was measured by eluting the conductive material using a 1N hydrochloric acid aqueous solution. The volume percentage of each material is shown in Table 1.

The sintered products obtained were processed into 5 mm×5 mm×30 mm cylinders and the room temperature resistivity and temperature dependency of resistivity were measured by the direct current-four terminal method. The results are shown in Table 1. Examples 1-1 through 1-3 and 1-11 through 1–15 are comparative examples, as the volume percent of conductive material in the sintered body is less than 20 vol % or more than 40 vol %.

Example II

Example II demonstrates the importance of maintaining 20 to 40 vol % electrically conductive particles in the sintered composite body.

Alumina powder (average primary particle diameter=1.1 $\mu$m; average secondary particle diameter=3 $\mu$m) was used as the high electrical resistance material and bismuth alloy (20 mol %)-gallium (80 mol %) (average primary particle diameter=25 $\mu$m) was used as the electrically conductive material in the mixing proportions shown in Table 2. The electrically conductive material was formed by atomization of the molten alloy in a non-oxidizing atmosphere. A sintering aid of $ZnO—B_2O_3—SiO_2$ was added in an amount of 3.0% by volume, in addition to 0.5 parts by weight sodium thiosulfate (deflocculant), 3 parts by weight methyl cellulose (water-soluble organic binder), and 60 parts by weight distilled water. These materials were then kneaded to obtain a slurry, which was thereafter spray dried to form 0.1 mm diameter granules (that contained both electrically conductive material and high electrical resistance material). The manufactured particles were then inserted into a metal mold and press formed into molded bodies. The bodies were then further pressure formed at a pressure of 7 ton/cm$^2$ with a hydrostatic-pressure, rubber-press machine.

The formed bodies were then dried at 100° C. and then preliminarily sintered at 900° C. for 4 hours in a hydrogen gas (reducing gas) flow of 5 l/minute. Thereafter, the bodies were primarily sintered at 1400° C. for 4 hours in a nitrogen atmosphere to form composite sintered bodies.

The volume ratio of the electrically insulating matrix and the conductive material in each of the sintered bodies was measured by eluting the conductive material using a 1N hydrochloric acid aqueous solution. The volume percentage of each material is shown in Table 2.

The room temperature resistivity and temperature dependency of resistivity were measured for each body in the same manner as in Example I. The results are shown in Table 2. Examples 2-1 through 2-4 and 2-14 through 2-18 are comparative examples, as the volume percent of conductive material in the sintered body is less than 20 vol % or more than 40 vol %.

As is clear from the results in Tables 1 and 2, only when the volume ratio of the conductive materials in the sintered body is within the range of about 20 to 40% is the ratio between high-temperature resistivity and room-temperature resistivity 10 or more (i.e., acceptable PTC properties are exhibited).

Example III

Example III shows the effect of varying the amount of Bi when using Bi—Sn alloy for the electrically conductive particles.

Alumina and boro-silicate glass were ground to an average particle size of 1.5 microns using a wet grinding process. A batch material was produced using 70.5 vol % of the ground alumina, 2.5 vol % of the ground boro-silicate glass, and 27.0 vol % Bi-based alloy, with varying amounts of Bi as indicated in Table 3. In every case, the alloy particles were viscous sieved in water to obtain particles ranging in size from 15 microns to 25 microns. An organic binder and water were added to the batch material to provide a raw material suitable for extrusion. Sample green bodies were extruded, dried, dewaxed in nitrogen gas, and then sintered in nitrogen gas at 1350° C. for four hours. The trip point temperature of each sample and the resistivity ratio (high temperature resistivity/room temperature resistivity) were measured in the same manner as in Examples I and II.

Figure 5:
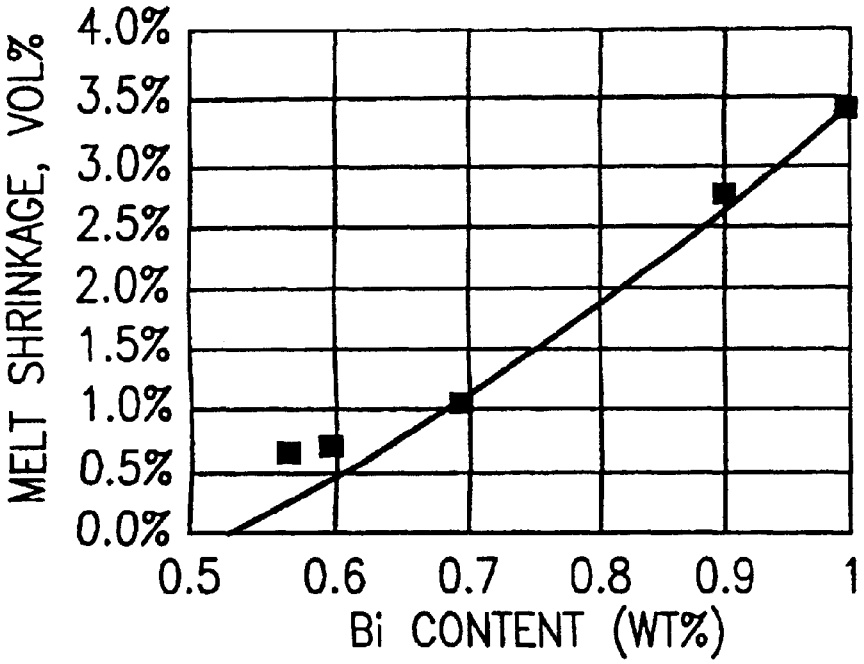
FIG. 5 is a graph showing melt shrinkage vs. Bi content when using Bi—Sn alloy particles.

Table 3 shows that a resistivity ratio of greater than 10 occurs when the Bi content in the alloy particles exceeds 60 wt %. It is at this composition that the alloy particles exhibit melt shrinkage of at least 0.5 vol %, as shown in FIG. 5.

TABLE 3

| Case | Bi Content (Wt %) | $T_{TP}$ Temp. (° C.) | Resitivity ratio ($\rho_{300° C.}/\rho_{30° C.}$) |
|---|---|---|---|
| 1 | 50 | 143 | 1 |
| 2 | 60 | 143 | 15 |
| 3 | 70 | 148 | $8.40 \times 10^3$ |
| 4 | 80 | 223 | $4.50 \times 10^5$ |
| 5 | 90 | 249 | $5.40 \times 10^5$ |
| 6 | 100 | 275 | $5.20 \times 10^5$ |

Example IV

Example IV shows the minimum amount of Bi needed in various alloy systems to achieve at least 0.5 vol % melt shrinkage.

Figure 6:
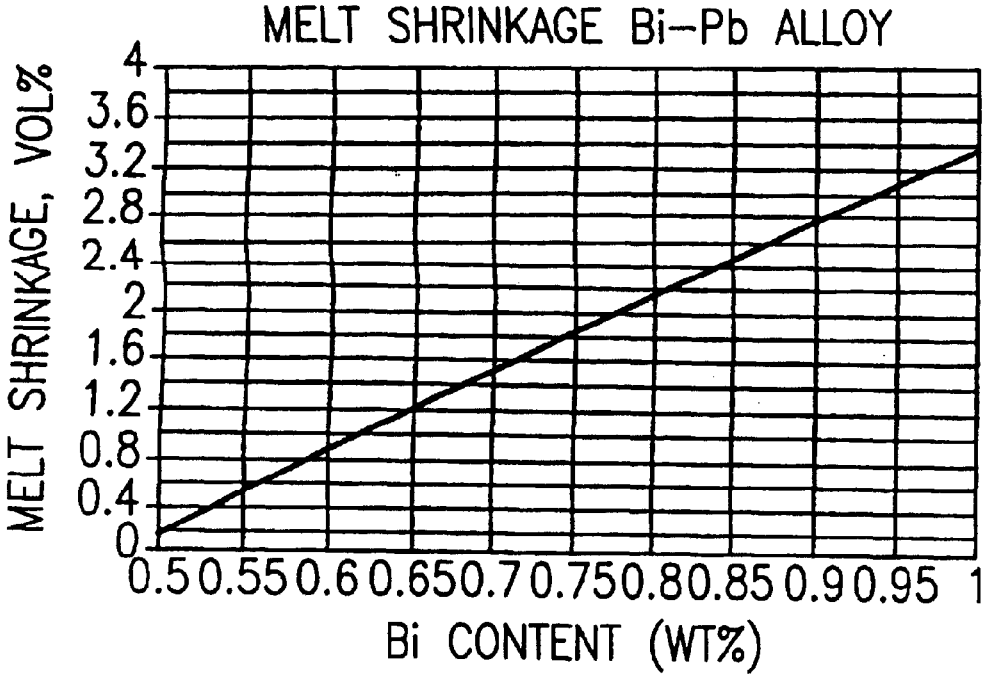
FIG. 6 is a graph showing melt shrinkage vs. Bi content when using Bi—Pb alloy particles.
Figure 7:
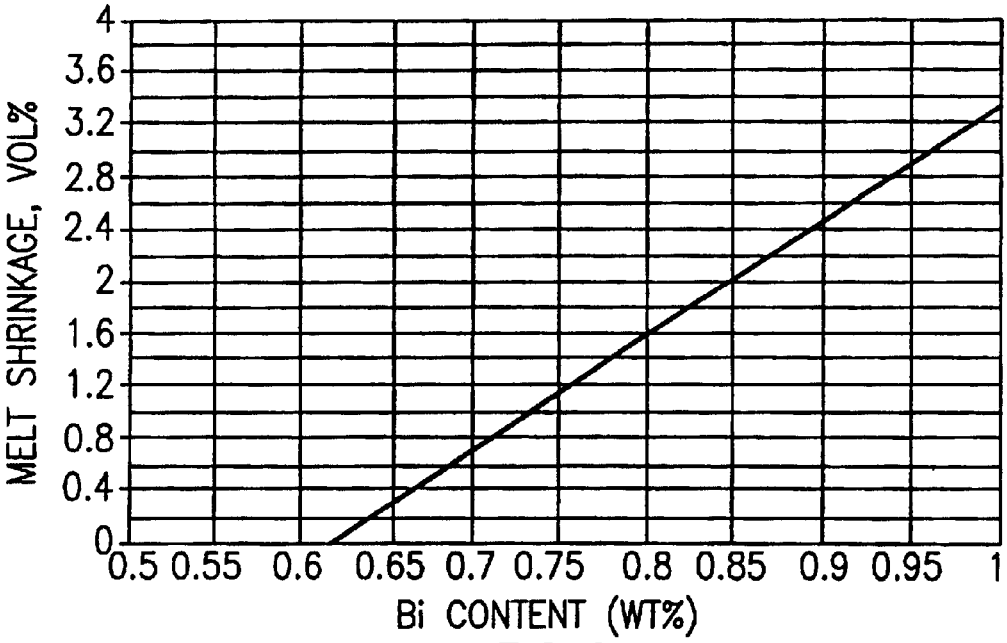
FIG. 7 is a graph showing melt shrinkage vs. Bi content when using Bi—Cd alloy particles.
Figure 8:
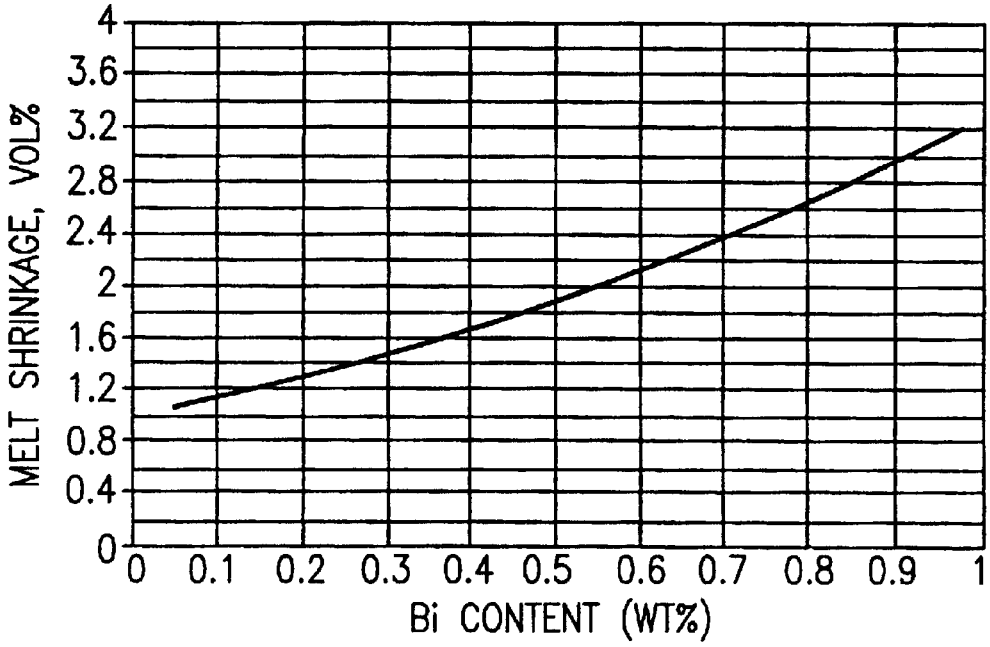
FIG. 8 is a graph showing melt shrinkage vs. Bi content when using Bi—Sb alloy particles.

The same process and procedure described in Example III was repeated with varying amounts of Bi in other alloy systems. The melt shrinkage in each case was determined, and is shown in FIGS. 6–8. It can be seen from these graphs that in the Bi—Pb alloy system, at least 55 wt % Bi is necessary to provide a melt shrinkage of at least 0.5 vol %. In the case of the Bi—Cd alloy system, as shown in FIG. 7, at least 67 wt % Bi is required. And, in the Bi—Sb alloy system, as shown in FIG. 8, any amount of Bi is adequate to achieve melt shrinkage of at least 0.5 vol %.

Example V

Example V shows the effect that particle size distribution of the electrically conductive particles has on the percolation range of the composite body.

Several ceramic-metal composite bodies were prepared using an alloy powder having a composition of 80 wt % Bi and 20 wt % Sn. The alloy powder was viscous sieved in water to separate the powder into four particle size categories: (i) less than 3.0 microns; (ii) 3–25 microns; (iii) 26–44 microns; and (iv) larger than 44 microns. Several different alloy powder combinations were used to prepare several samples, as described in Table 4. In each sample, the sintered body was formed using 27 vol % alloy powder, 70.5 vol % mullite powder, and 2.5 vol % boro-silicate glass. The batch materials were mixed and pressed into plate form, and then sintered in nitrogen atmosphere at 1300° C. for three hours.

Table 4 shows that in each case, the resistivity ratio was substantial. However, the

TABLE 4

Figure 9:
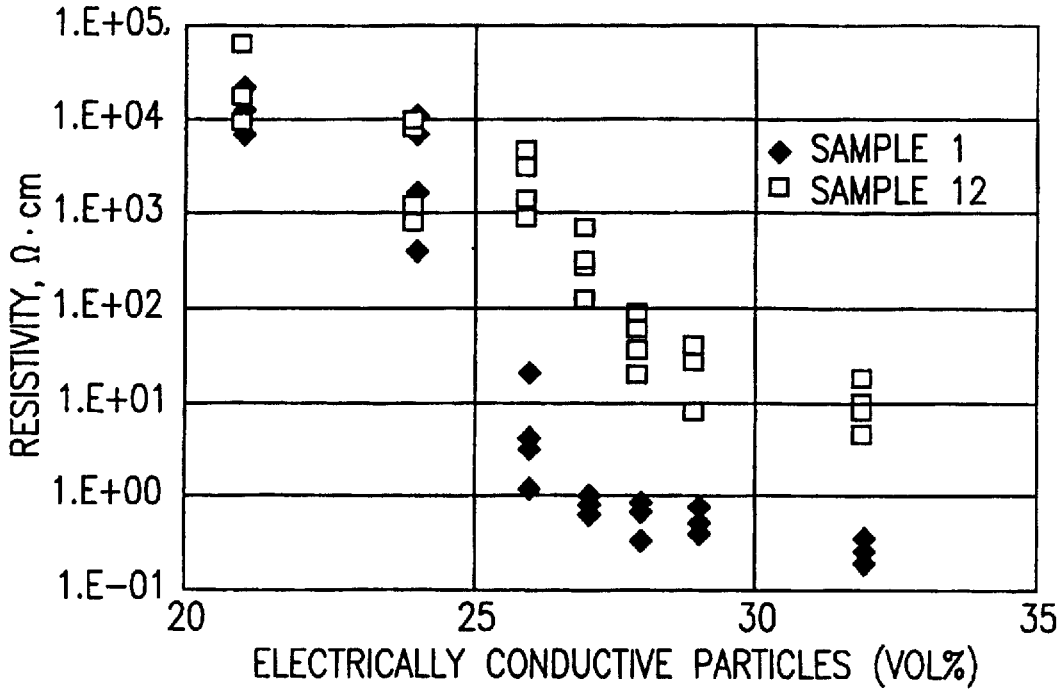
FIG. 9 is a graph of room temperature (i.e., 30° C.) resistivity vs. volume percent of conductive particles for two samples from Example V.

| Sample | Volumetric Amount of Each Particle Size Powder | | | | Percolation Limit of Resistivity Ωcm | |
|---|---|---|---|---|---|---|
| | | 3 μm to | 26 μm to | | | |
| No. | ~<3 μm | 25 μm | 44 μm | >44 μm | 30° C. | 300° C. |
| 1 | 0 | 0 | 100 | 0 | 0.96 | $2.03 \times 10^5$ |
| 2 | 0 | 20 | 60 | 20 | 0.82 | $2.49 \times 10^4$ |
| 3 | 0 | 40 | 40 | 20 | 0.64 | $1.47 \times 10^4$ |
| 4 | 3 | 0 | 97 | 0 | 0.68 | $3.06 \times 10^4$ |
| 5 | 3 | 20 | 57 | 20 | 0.86 | $9.52 \times 10^4$ |
| 6 | 3 | 40 | 37 | 20 | 1.21 | $6.47 \times 10^4$ |
| 7 | 5 | 0 | 95 | 0 | 1.19 | $3.21 \times 10^5$ |
| 8 | 5 | 20 | 55 | 20 | 3.22 | $1.26 \times 10^5$ |
| 9 | 5 | 40 | 35 | 20 | 4.06 | $8.68 \times 10^4$ |
| 10 | 10 | 0 | 90 | 0 | 17.74 | $1.59 \times 10^4$ |
| 11 | 10 | 20 | 50 | 20 | 33.36 | $5.28 \times 10^4$ |
| 12 | 10 | 40 | 30 | 20 | 67.43 | $1.31 \times 10^5$ |

plot in FIG. 9 shows that the particle distribution of alloy powder effects the percolation behavior of the resultant composite body. In the case of a narrow particle size range, such as Sample 1 in Table 4, the percolation threshold is much sharper than in the case of a relatively wide particle distribution, such as Sample 12.

Example VI

Example VI shows the effect of using an intermediate layer when forming the termination electrodes on the PTC device.

Figure 10:
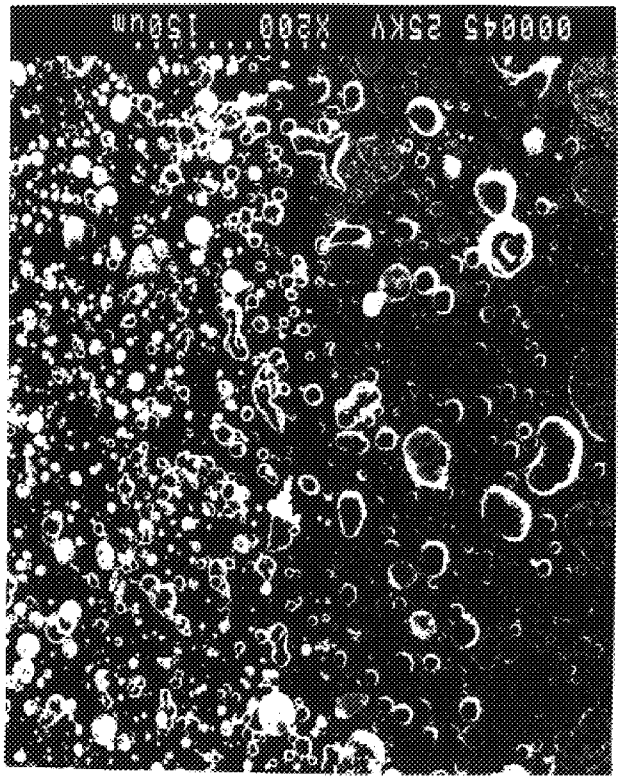
FIGS. 10–13 are SEM photographs showing the electrode interface regions of the samples from Example VI.

Three samples were prepared using composite materials including the alloy powder from Example V and alumina as the electrically insulating ceramic matrix material. Three different materials for the intermediate electrode layer were formed as shown in Table 5, and those materials were applied to opposite surfaces of the composite bodies while in the green state. The laminated structures were then cofired in the same manner described in the other examples. Conventional electrode materials, such as Ni or Cu, were then formed on the intermediate electrode layer. FIGS. 10–13 show the interface between the sintered composite body and the cosintered, dual-layered electrode structure. FIG. 10 shows the case where an Fe-alumina material is used as the intermediate layer.

TABLE 5

Figure 11:
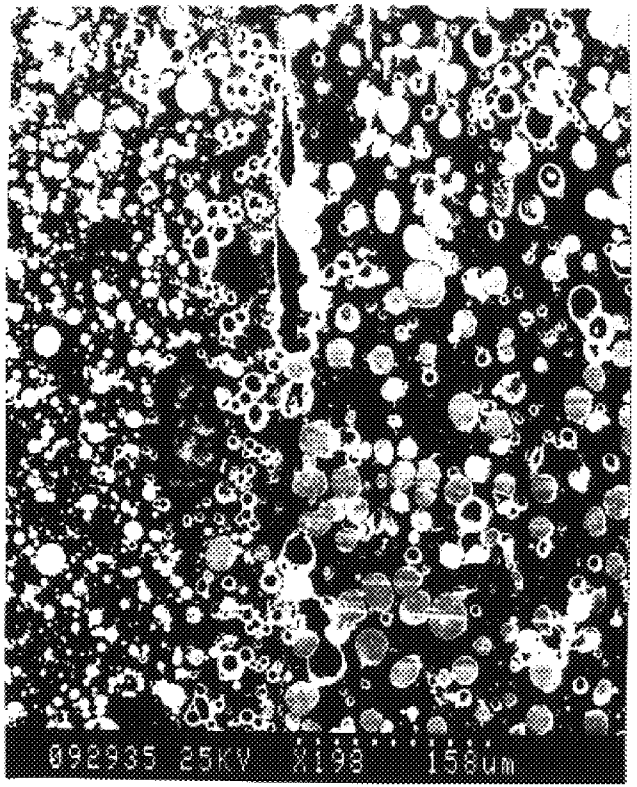
Figure 12:
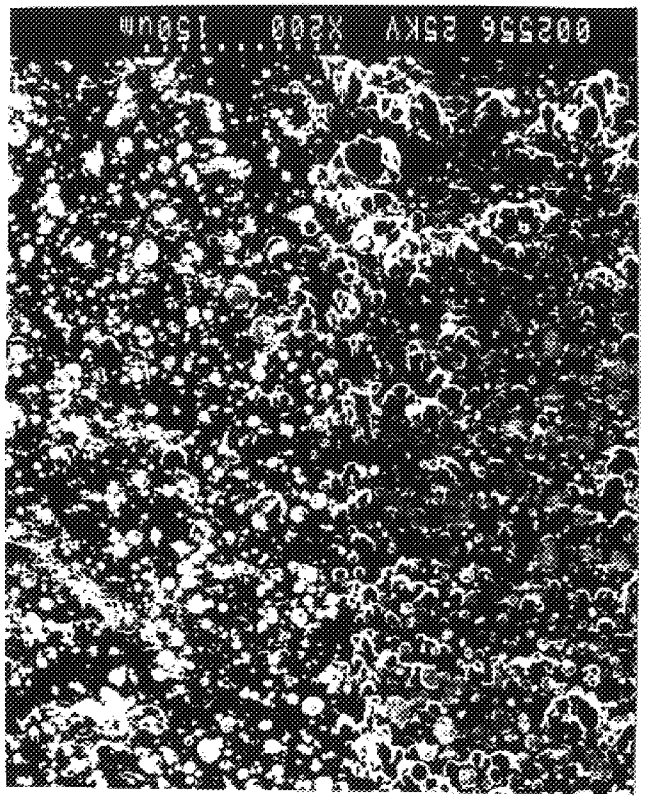
Figure 13:
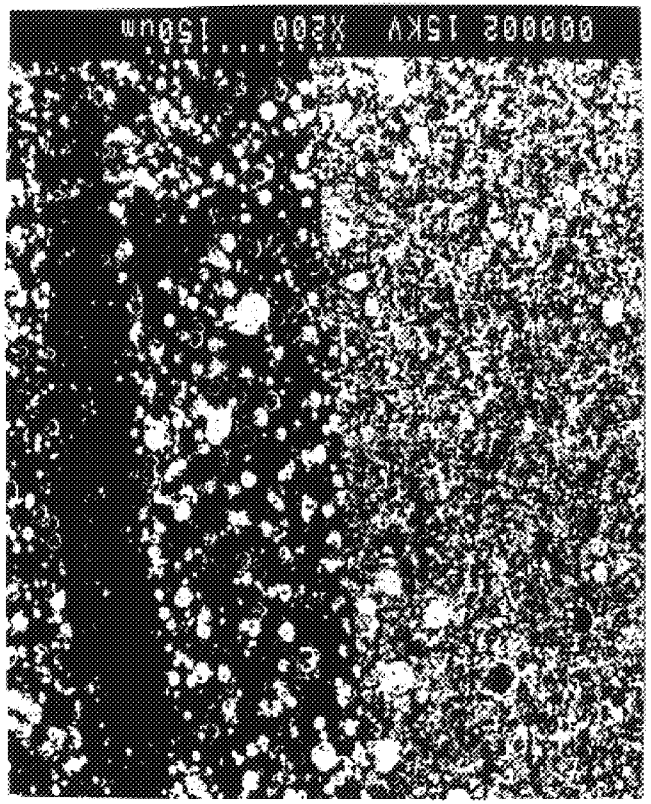

| No. | Conductive Material | Volumetric % of Conductive Material | Insulating Material | Volumetric % of Insulating Material | Electrical Contact | Figure |
|---|---|---|---|---|---|---|
| 5-1 | W | 40.05% | alumina | 59.95% | good (less than 0.1 milli-ohm-cm$^2$) | FIG. 13 |
| 5-2 | Ni | 40.05% | alumina | 59.95% | bad (greater than 1 k-ohm-cm$^2$) | FIG. 12 |
| 5-3 | Cu | 40.05% | alumina | 59.95% | bad (greater than 1 k-ohm-cm$^2$) | FIG. 11 |

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. An inorganic PTC device, comprising:

an inorganic-metal composite body comprising an electrically insulating inorganic matrix and first electrically conductive particles uniformly dispersed in said matrix and forming a three-dimensional conductive network extending from a first surface of said body to an opposed second surface thereof;

an intermediate layer formed on each of said first and second surfaces of said body, said intermediate layer comprising inorganic particles and second electrically conductive particles uniformly dispersed therein, wherein said second particles (i) have a higher melting point temperature than said first particles, and (ii) will not form a eutectic allay or intermetallic compound with said first particles during manufacture or use of said device; and an outer electrode layer adhered to each of said intermediate layers, said outer electrode layer consisting essentially of third electrically conductive particles that are compositionally different from said first and second particles.

2. The inorganic PTC device of claim 1, wherein said inorganic-metal composite body further comprises said second electrically conductive particles uniformly dispersed therein.

3. The inorganic PTC device of claim 2, wherein said second electrically conductive particles are present in said inorganic-metal composite body in an amount less than 50 vol % with respect to the total amount of electrically conductive particles present in said inorganic-metal composite body.

4. The inorganic PTC device of claim 1, wherein said second electrically conductive particles are selected from the group consisting of Cr, Zr, W and Mo, silicides of Cr, Zr, W, Mo, V, Nb, Ta, Hf, borides of Cr, Zr, W, Mo, V, Nb, Ta, Hf, carbides of Cr, Zr, W, Mo, V, Nb, Ta, Hf and nitrides of Cr, Zr, W, Mo, V, Nb, Ta, Hf.

5. The inorganic-metal composite body of claim 1, wherein said first electrically conductive particles consist essentially of at least one alloy selected from Bi—Sn, Bi—Pb, Bi—Cd, Bi—Sb, Bi—Sn—Ga, Bi—Sn—Pb and Bi—Sn—Cd.

6. The inorganic-metal composite body of claim 1, wherein said electrically insulating inorganic matrix consists essentially of alumina, silica, zirconia, magnesia, mullite, cordierite, petalite, eucryptite, aluminum silicate, forsterite and quartz glass.

7. An inorganic PTC device, comprising:

an inorganic-metal composite body comprising an electrically insulating inorganic matrix and first and second electrically conductive particles uniformly dispersed in said matrix and forming a three-dimensional conductive network extending from a first surface of said body to an opposed second surface thereof, wherein said second electrically conductive particles have a higher melting point temperature than said first particles and will not form a eutectic alloy or intermetallic compound with said first electrically conductive particles during manufacture or use of said device.

8. The inorganic PTC device of claim 7, wherein said second electrically conductive particles are present in said inorganic-metal composite body in an amount less than 50 vol % with respect to the total amount of electrically conductive particles present in said inorganic-metal composite body.

9. The inorganic-metal composite body of claim 7, wherein said first electrically conductive particles consist essentially of at least one alloy selected from Bi—Sn, Bi—Pb, Bi—Cd, Bi—Sb, Bi—Sn—Ga, Bi—Sn—Pb and Bi—Sn—Cd.

10. The inorganic PTC device of claim 9, wherein said second electrically conductive particles are selected from the group consisting of Cr, Zr, W and Mo, silicides of Cr, Zr, W, Mo, V, Nb, Ta, Hf, borides of Cr, Zr, W, Mo, V, Nb, Ta, Hf, carbides of Cr, Zr, W, Mo, V, Nb, Ta, Hf and nitrides of Cr, Zr, W, Mo, V, Nb, Ta, Hf.

11. The inorganic-metal composite body of claim 7, wherein said electrically insulating inorganic matrix consists essentially of alumina, silica, zirconia, magnesia, mullite, cordierite, petalite, eucryptite, aluminum silicate, forsterite and quartz glass.

* * * * *